US011802755B2

(12) United States Patent
Berg

(10) Patent No.: US 11,802,755 B2
(45) Date of Patent: Oct. 31, 2023

(54) PENETRATOR, USE OF A PENETRATOR, AND PROJECTILE

(71) Applicant: Rheinmetall Waffe Munition GmbH, Suedheide (DE)

(72) Inventor: Martin Berg, Celle (DE)

(73) Assignee: Rheinmetall Waffe Munition GmbH, Suedheide (DE)

( * ) Notice: Subject to any disclaimer, the term of this patent is extended or adjusted under 35 U.S.C. 154(b) by 0 days.

(21) Appl. No.: 17/710,327

(22) Filed: Mar. 31, 2022

(65) Prior Publication Data

US 2022/0221259 A1 Jul. 14, 2022

Related U.S. Application Data

(63) Continuation of application No. PCT/EP2020/074278, filed on Sep. 1, 2020.

(30) Foreign Application Priority Data

Oct. 2, 2019 (DE) ..... 10 2019 126 604.1

(51) Int. Cl.
*F42B 12/06* (2006.01)

(52) U.S. Cl.
CPC ..... *F42B 12/06* (2013.01)

(58) Field of Classification Search
CPC ..... F42B 12/06
USPC ..... 102/518
See application file for complete search history.

(56) References Cited

U.S. PATENT DOCUMENTS 3,370,535 A * 2/1968 Permutter ..... F42B 12/06 102/518
4,108,072 A 8/1978 Trinks et al.
4,612,860 A * 9/1986 Flatau ..... F42B 12/06 102/501
4,708,063 A * 11/1987 Ladriere ..... F42B 10/22 102/516
4,878,434 A * 11/1989 Sommet ..... F42B 12/78 102/514
4,970,960 A * 11/1990 Feldmann ..... F42B 12/06 102/501
6,305,293 B1 * 10/2001 Fry ..... F42B 12/78 102/527
6,662,726 B1 12/2003 Steiner
(Continued)

FOREIGN PATENT DOCUMENTS

DE 1428679 C1 9/1977
DE 2924217 A1 12/1980
(Continued)

OTHER PUBLICATIONS

International Search Report dated Nov. 9, 2020 in corresponding application PCT/EP2020/074278.

*Primary Examiner* — Samir Abdosh
(74) *Attorney, Agent, or Firm* — Muncy, Geissler, Olds & Lowe, P.C.

(57) ABSTRACT

A penetrator for a projectile having a guide mechanism, the penetrator comprising at least one solid main body that acts in a terminal ballistic manner for attacking an armoured target, more particularly a tank having reactive armour, a rear region of the penetrator having a hard core that acts in a terminal ballistic manner which improves the penetration effect and is permanently connected to the main body.

9 Claims, 8 Drawing Sheets

(56) References Cited

U.S. PATENT DOCUMENTS

| | | | | |
|---|---|---|---|---|
| 7,231,876 | B2 | 6/2007 | Kellner | |
| 7,455,015 | B2 * | 11/2008 | Krstic | F42B 12/74 102/439 |
| 8,176,850 | B2 * | 5/2012 | Thompson | F42B 12/74 102/501 |
| 2004/0069176 | A1 | 4/2004 | Kellner | |
| 2007/0006766 | A1 | 1/2007 | Kellner | |
| 2007/0017409 | A1 * | 1/2007 | Mansfield | F42B 12/06 102/518 |
| 2007/0204758 | A1 * | 9/2007 | Spatz | F42B 12/78 102/514 |
| 2008/0035008 | A1 * | 2/2008 | Riess | F42B 30/02 102/518 |

FOREIGN PATENT DOCUMENTS

| | | | |
|---|---|---|---|
| DE | 3339078 | A1 | 5/1985 |
| DE | 2554600 | C1 | 6/1988 |
| DE | 3933442 | A1 | 4/1991 |
| DE | 4023482 | A1 | 1/1992 |
| DE | 4028409 | A1 | 3/1992 |
| DE | 4042344 | A1 | 6/1993 |
| DE | 3534101 | C1 | 5/2000 |
| DE | 19948710 | A1 | 4/2001 |
| EP | 0300373 | B1 | 6/1992 |
| EP | 1316774 | A1 | 6/2003 |
| WO | WO03046470 | A1 | 6/2003 |
| WO | WO2004003460 | A1 | 1/2004 |

* cited by examiner

PENETRATOR, USE OF A PENETRATOR, AND PROJECTILE

This nonprovisional application is a continuation of International Application No. PCT/EP2020/074278, which was filed on Sep. 1, 2020, and which claims priority to German Patent Application No. 10 2019 126 604.1, which was filed in Germany on Oct. 2, 2019, and which are both herein incorporated by reference.

BACKGROUND OF THE INVENTION

Field of the Invention

The present invention relates to a penetrator for a projectile with a tail assembly. The penetrator includes at least one solid main body that acts in a terminal ballistic manner for attacking an armored target, in particular a tank with reactive armor. In addition, the invention relates to a use of such a penetrator for attacking an armored target with a reactive armor module. Furthermore, the invention also relates to a projectile with a sabot and a tail assembly, wherein the projectile includes such a penetrator.

Description of the Background Art

A penetrator is a sub-caliber kinetic energy projectile that achieves its effects through kinetic energy. Such projectiles are usually fired at a target in direct fire by tanks or artillery with large-caliber guns.

Normal, sub-caliber penetrators are customarily used for attacking modern, reactive protection systems. One example of this type of penetrator is the DM 53/DM 63 production projectile from the Rheinmetall company.

Conventional penetrators are often designed in one piece as solid penetrators and have a homogeneous body. Such penetrators are known from DE 199 48 710 A1 and DE 40 28 409 A1, for example.

DE 40 42 344 discloses a penetrator that is formed from a multiplicity of cores that are nested in a sleeve. An energy absorbing device can be formed in the rear part of the projectile.

Known from the document DE 25 54 600 C1 is a kinetic energy projectile that has a hollow projectile case and a movable core arranged therein. Upon impact, the core is retarded within the projectile case and a sleeve is driven apart radially by the core in order to achieve a broad effect.

A penetrator is known from DE 39 33 442 A1 that has a separable tail assembly, wherein an explosive charge and a movable firing pin are provided in the interior of the projectile.

An active effective body that has an improved lateral effect is known from the documents WO 2004/003460 A1, which corresponds to US 2004/0069176, and from EP 1 316 774 A1, which corresponds to US 2003/0167956. The lateral effect is achieved by ignition of the active component of the effective body.

Moreover, a penetrator is known from EP 0 300 373 B1 that has a tracer composition in its rear.

A penetrator with a tail assembly screwed to the rear is known from DE 29 24 217 A1.

A penetrator is known from the document DE 33 39 078 A1 that is formed by two bodies connected to one another in a casing. Formed in the rear region of the penetrator is a tracer composition.

Moreover, penetrators are known, for example from DE 35 34 101 C1, that are composed of two projectiles, which is to say have a pre-penetrator and a following penetrator. These are connected before firing, and are intended to separate from one another in flight so that one shot causes two projectiles to strike a target in immediate succession.

It has become apparent that the terminal ballistic performance in the target depends not only on the geometry of the tip of the penetrator, but is also influenced by the geometry of the rear. Previous penetrators completely disregard this fact. The penetrator erodes in the target, and consequently the rear of the penetrator is very severely deformed. This deformed material from the rear region of the penetrator then has only poor terminal ballistic performance. The rear geometries of existing penetrators heretofore have not been optimized, and are intended only to accommodate a tail assembly or a tracer composition. The disadvantage is that heretofore, once the front part of the penetrator is eroded, the rear region no longer has a defined geometry. Good residual terminal ballistic performance of the rear region is therefore not predefined, but instead results more or less randomly, at best, on account of the erosion pattern of the penetrator.

It is a disadvantage of the known penetrators that, for this reason, they are not suitable to pierce a very heavily armored target or an armored target with reactive armor modules.

SUMMARY OF THE INVENTION

It is therefore an object of the present invention to provide a penetrator that has improved penetrating power.

According to an exemplary embodiment of the invention, a penetrator for a projectile with a tail assembly is provided, wherein the penetrator comprises at least one solid main body that acts in a terminal ballistic manner for attacking an armored target, in particular a tank with reactive armor, wherein a rear region of the penetrator has, permanently connected to the main body, a hard core that acts in a terminal ballistic manner to improve the penetration effect.

In addition, a use of such a penetrator, or an improved penetrator as described below, for attacking an armored target with a reactive armor module is provided according to the invention.

Furthermore, a projectile with a sabot and a tail assembly is created according to the invention, wherein the projectile includes such a penetrator or an improved penetrator as described below.

This achieves the result that the outer body of the penetrator has an improved penetrating power as compared with a production penetrator, such as the applicant's DM53 or DM63, for example.

"Attacking an armored target" within the meaning of the invention provides for a destruction of a main target.

"Acting in a terminal ballistic manner" within the meaning of the invention means that a ballistic effect suitable for destroying the target is achieved by an element acting in a terminal ballistic manner.

The "rear region" of the penetrator within the meaning of the invention is preferably the last tenth, further preferably the last fifteenth, of the penetrator length.

"Permanently connected" within the meaning of the invention means that the hard core and the main body are connected to one another both during launching of the penetrator and during impact in the target. The hard core and main body are permanently connected in such a manner that the hard core and the main body act jointly in a terminal ballistic manner.

The hard core and the main body should not be movable relative to one another in the connected state.

The connection between the main body and the hard core can be made in an integral manner, such as by adhesive bonding, for example. Moreover, the connection can be made in a frictional and/or interlocking manner. One example of an integral connection is gluing. One example of an interlocking connection is a screw connection, and one example of a frictional connection is a press fit. A combination of the abovementioned variants is likewise possible.

The main body is designed in one piece.

The penetrator is preferably a penetrator for large-caliber, armor-piercing kinetic energy munitions against reactive protection systems.

A good piercing effect in the main target is achieved by the design according to the invention. This is accomplished by optimization of the rear region of the penetrator with regard to terminal ballistic performance. In particular, the terminal ballistic performance of armor-piercing penetrators is improved by the invention. If the front region of the penetrator is eroded upon impact with a target, the remaining (residual) penetration is accomplished by a defined geometry of the hard core in the rear.

Another advantage is that the solution according to the invention has no moving parts and the construction of the penetrator has comparatively little complexity.

Moreover, it is possible by means of the hard core to optimally match the rear region of the penetrator to the targets to be attacked. Furthermore, the material of the rear region of the main body can be matched to the target to be attacked.

In an improvement of the invention, provision can be made that the rear region can taper toward the rear of the penetrator compared with the main body. The rear region can be tapered in a stepped or continuous manner in this case.

The fact that the rear region has a defined tapering geometry achieves the result that the rear region of the penetrator can pass with no great resistance through the passage already punched in the target by the front part of the penetrator.

Moreover, the penetrator can be an inert penetrator. The penetrator can thus be a passive penetrator that has no explosive charge. Both the hard core and the main body are inert.

In an advantageous improvement, the density of the hard core can be greater than the density of the main body. This achieves the result that the hard core has an improved penetrating power compared with the main body.

The hard core and the penetrator can be made of a metal.

In implementation of the penetrator, the hard core can be made of a high-strength material, in particular a sintered tungsten/heavy metal material.

Furthermore, provision can be made that the hard core can be made of tungsten carbide.

In implementation of the penetrator, the outer body can be manufactured from tungsten heavy metal.

Tungsten heavy metals are defined in the ASTM B777-07 material standard, for example.

The hard core and the main body can be designed to be metallically or metallurgically different in this case.

Provision can additionally be made that the main body can be composed of a sintered tungsten heavy metal and the hard core is composed of a sintered tungsten heavy metal, wherein the tungsten heavy metal of the hard core is more strongly compacted than the tungsten heavy metal of the main body.

In an improvement of the penetrator, provision can be made that the mass ratio of hard core to main body is greater than 1:10, preferably is greater than 1:15.

In an improvement, provision can be made that the hard core tapers toward the front. This shape that tapers toward the front achieves the result that the hard core has an improved residual penetration effect.

In implementation, provision can further be made that the hard core can have at least one step. This achieves the result that an improved penetration effect is achieved by the front of the hard core, but the hard core nevertheless still has sufficient mass on account of its larger rear region.

Provision can further be made that the front of the hard core can be pointed or rounded.

In an improvement, provision can additionally be made that the hard core can be arranged within the main body.

Furthermore, provision can be made that the penetrator can be lengthened by the hard core as compared with the main body. This achieves the result that the rear region of the penetrator is formed by the hard core, thereby forming the geometry of the rear region.

In an advantageous implementation of the penetrator, provision can be made that the mass of the penetrator is less than 7 kg, preferably less than 6 kg.

In an improvement of the penetrator, provision can be made that the main body and the hard core are constituted such that they have no fragmentation effect or only a negligible fragmentation effect on impact with a target.

Furthermore, in an implementation of the projectile, it is also possible to design the tail assembly in such a manner that the tail assembly of the projectile increases the terminal ballistic effect of the projectile by being modified such that the penetrating power is increased.

Furthermore, a hard core can be arranged in the rear region instead of a tracer composition.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
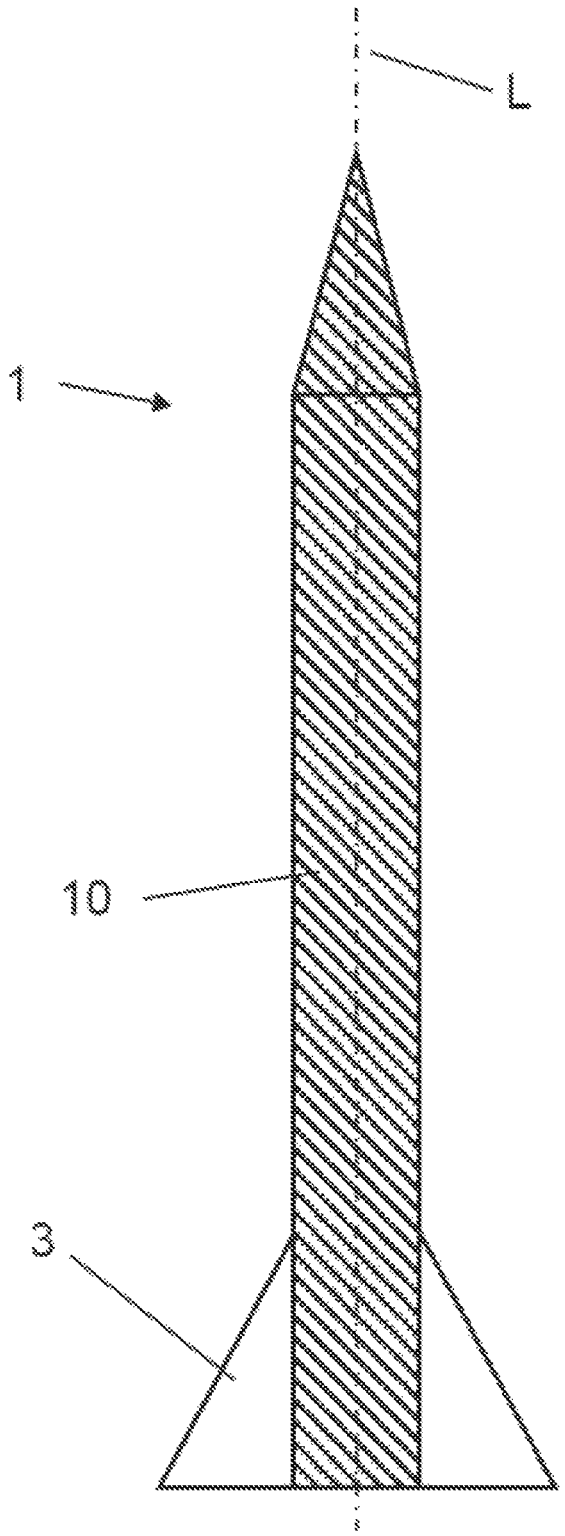
prior art Fig. 1
FIG. 1 is a schematic sectional representation of a production penetrator according to the prior art.

FIG. 1 shows a schematic sectional representation of a projectile 1 with a production penetrator, which is to say a penetrator 10, according to the prior art. The penetrator 10 is designed to be solid.

Figure 2:
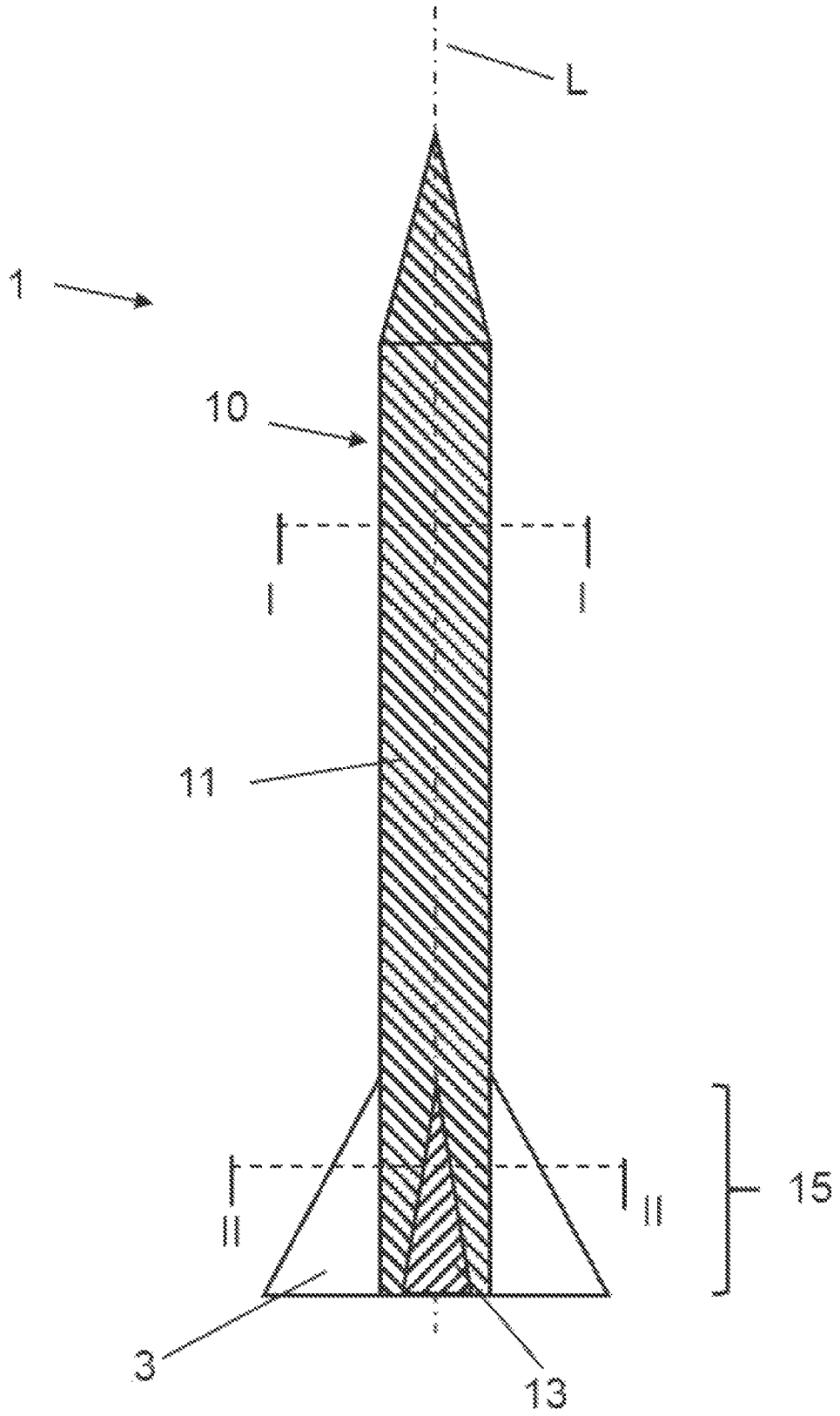
FIG. 2 is a schematic sectional representation of a penetrator according to the invention in accordance with an example.

FIG. 2 shows a schematic sectional representation of a projectile 1 comprising a penetrator 10 according to the invention in accordance with a first embodiment. The projectile 1 has a tail assembly 3. The penetrator 10 has at least one main body 11 that acts in a terminal ballistic manner for attacking an armored target, in particular a tank with reactive armor.

A rear region 15 of the penetrator 10 has, permanently connected to the main body 11, a hard core 13 that acts in a terminal ballistic manner to improve the penetration effect.

As is evident from FIG. 2, the hard core 13 is arranged within the main body 11.

The penetrator 10 is implemented as an inert penetrator, which is to say that it has no explosive or other active agent.

The density of the hard core 13 is greater than the density of the main body 11.

The main body 11 can be composed of a sintered tungsten heavy metal and the hard core 13 is composed of a sintered tungsten heavy metal, wherein the tungsten heavy metal of the hard core 13 is more strongly compacted than the tungsten heavy metal of the main body 11.

As is evident from FIG. 2, the hard core 13 tapers toward the front F.

The front F of the hard core 13 is pointed in design.

In implementation, the hard core is at least partially or else entirely conical or designed as a truncated cone.

Figure 3:
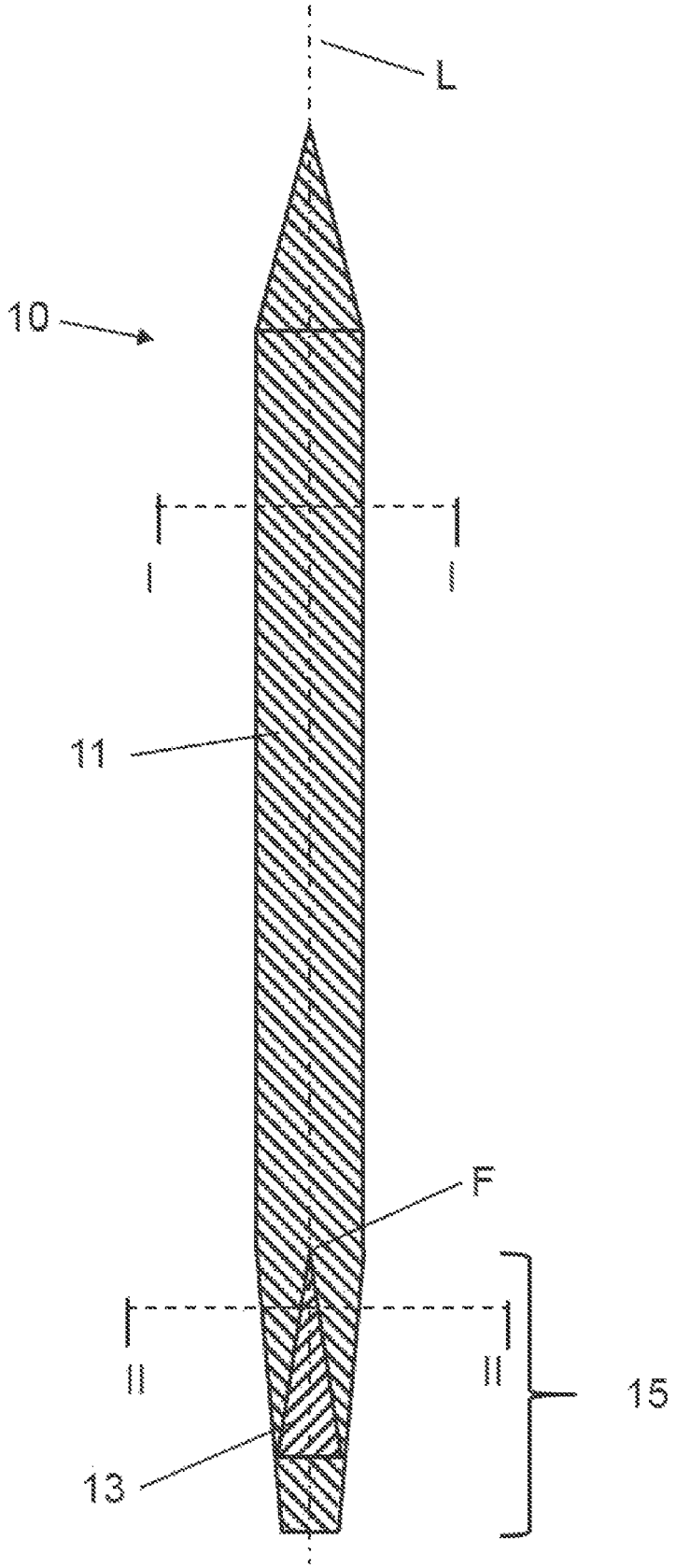
FIG. 3 is a schematic sectional representation of a penetrator according to the invention in accordance with an example.

FIG. 3 shows a schematic sectional representation of a penetrator 10 according to the invention in accordance with a second embodiment. The second embodiment is based on the first embodiment, with only the differences from the first embodiment being discussed below.

In accordance with the second embodiment, the rear region 15 is designed to be tapered toward the rear of the penetrator 10 as compared with the main body 11. Consequently, the rear part of the penetrator, which is to say the rear region 15, is tapered as compared with an essentially cylindrical region located in front thereof.

In a similar manner as in the embodiment in accordance with FIG. 2, the hard core 13 is arranged within the main body 11.

Furthermore, the hard core 13 has a tip at the front F.

Figure 4:
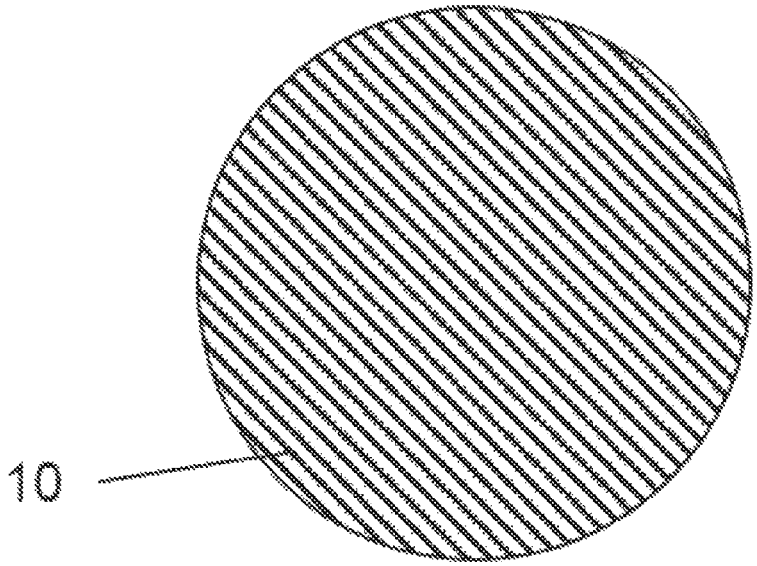
FIG. 4 is a schematic sectional representation of the penetrator according to the invention in accordance with FIGS. 2 and 3 along the line I-I.

FIG. 4 shows a schematic sectional representation of the penetrator 10 according to the invention in accordance with FIGS. 2 and 3 along the line I-I. In this depiction, the main body 11 of the penetrator 10 is sectioned. As is evident from FIG. 4, the cross-section of the main body 11 is circular. It can also be a trapezoidal or a polygonal cross-section, however.

Figure 5:
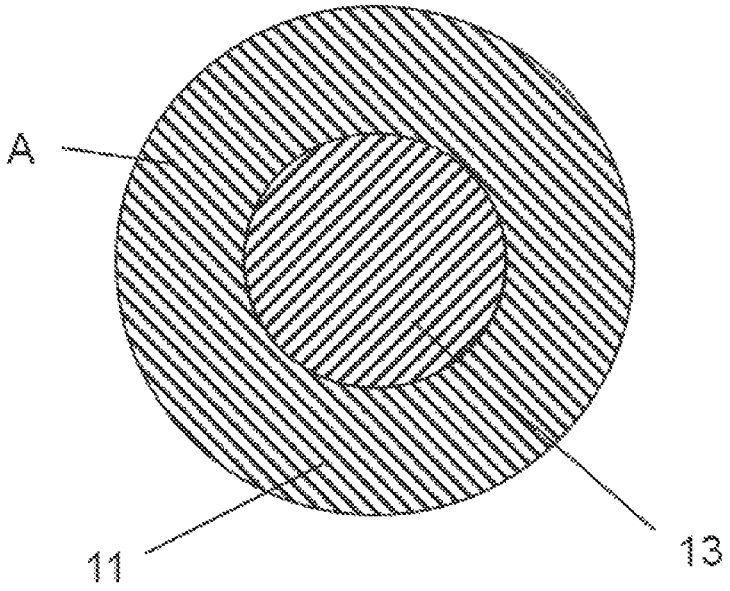
FIG. 5 is a schematic sectional representation of the penetrator according to the invention in accordance with FIGS. 2 and 3 along the line II-II.

FIG. 5 shows a schematic sectional representation of the penetrator 10 according to the invention in accordance with FIGS. 2 and 3 along the line II-II. In this depiction, both the main body 11 of the penetrator 10 and the hard core 15 are sectioned.

As stated above, the penetrator 10 has, arranged at least partially in the main body 11, a hard core 13 that acts in a terminal ballistic manner.

So that the outer body 11 and the hard core 13 both act together in a terminal ballistic manner, they are connected to one another in an interlocking and/or frictional and/or integral manner.

The hard core 13 is made, for example, from a high-strength material, in particular a sintered tungsten/heavy metal material or a high-strength steel.

As is evident from FIG. 5, the cross-section of the hard core 13 is circular. It can also be a trapezoidal or a polygonal cross-section, however.

Figure 6:
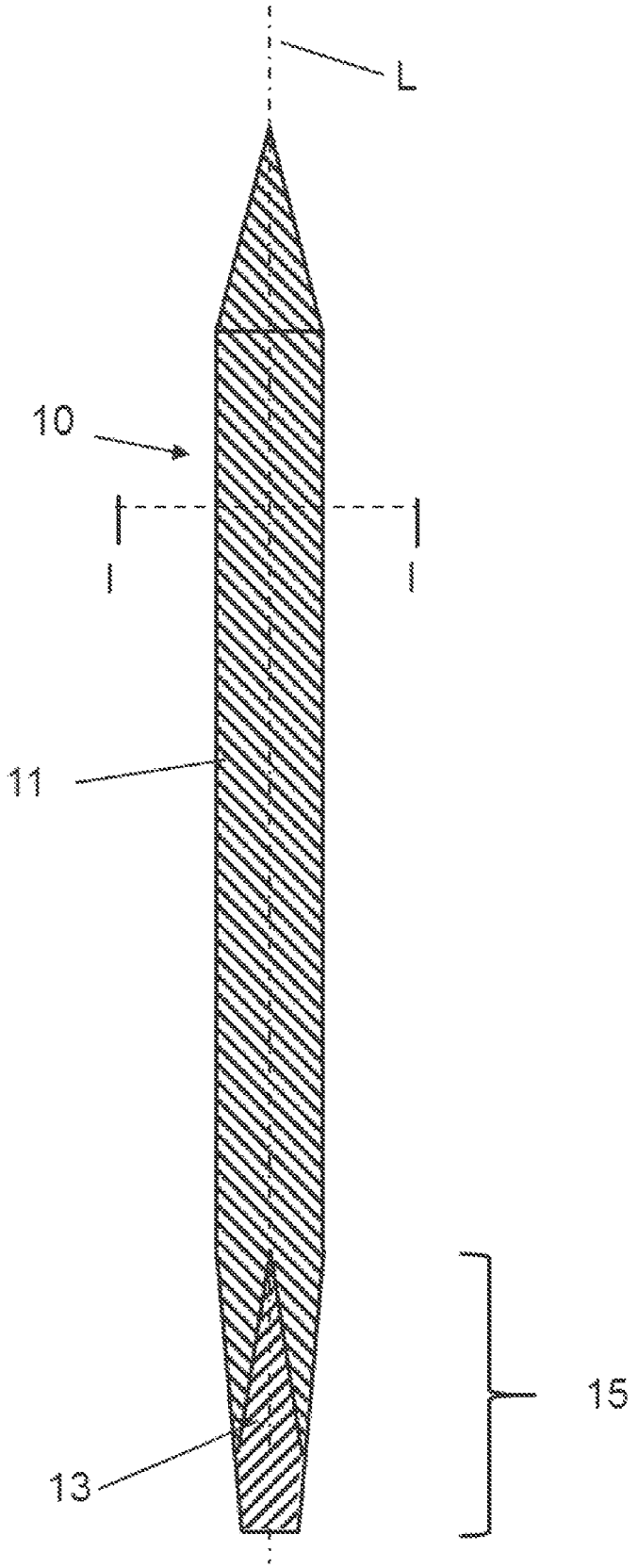
FIG. 6 is a schematic sectional representation of a penetrator according to the invention in accordance with a third embodiment.

In accordance with FIG. 6, a schematic sectional representation of a penetrator 10 according to the invention is shown in accordance with a third embodiment. The third embodiment is based on the second embodiment, with only the differences from the second embodiment in accordance with FIG. 3 being discussed below.

In accordance with the third embodiment, the penetrator 10 is lengthened by the hard core 13 as compared with the main body 11. The hard core 13 thus forms the rear of the penetrator 10.

Figure 7:
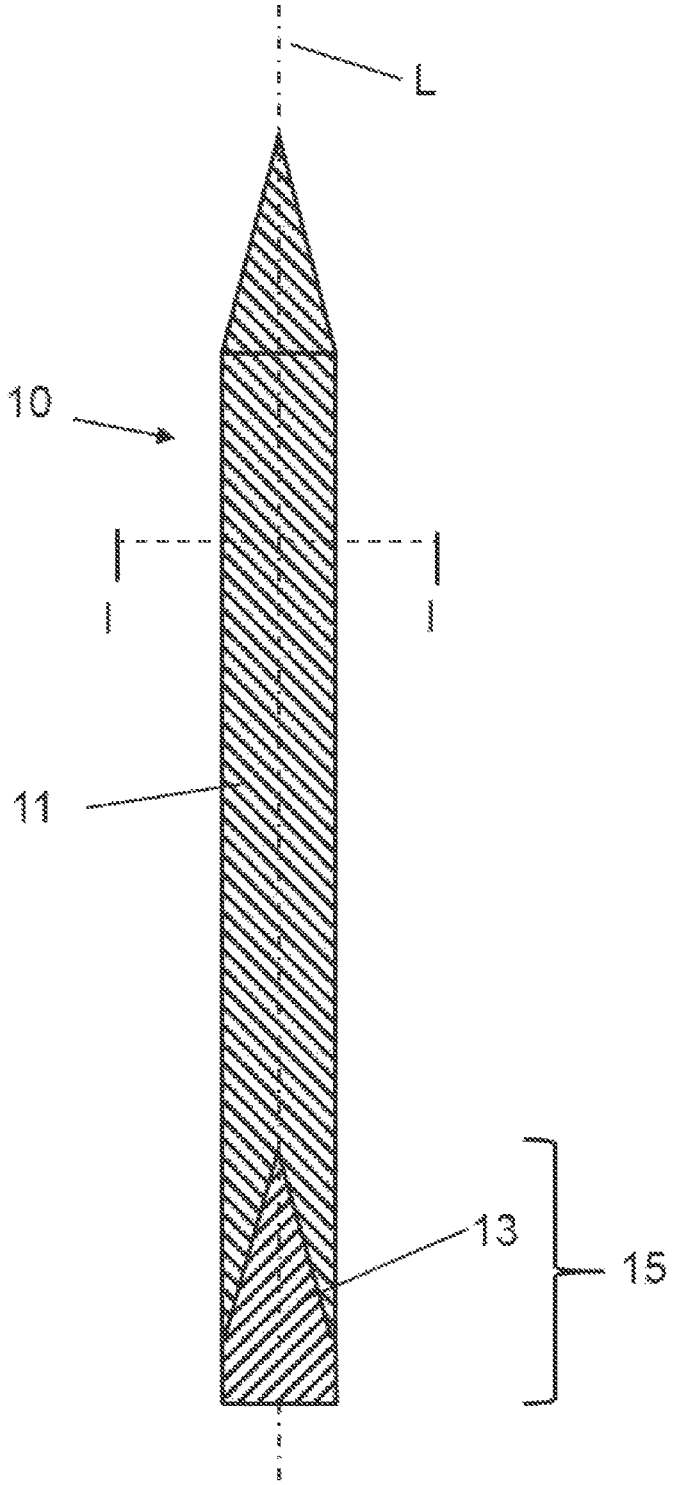
FIG. 7 is a schematic sectional representation of a penetrator according to the invention in accordance with a fourth embodiment.

FIG. 7 shows a schematic sectional representation of a penetrator 10 according to the invention in accordance with a fourth embodiment. The fourth embodiment is based on the first embodiment, with only the differences from the first embodiment in accordance with FIG. 2 being discussed below.

In a departure from the first exemplary embodiment, the penetrator 10 is lengthened by the hard core 13 as compared with the main body 11. The hard core 13 thus forms the rear of the 10 penetrator.

Figure 8A:
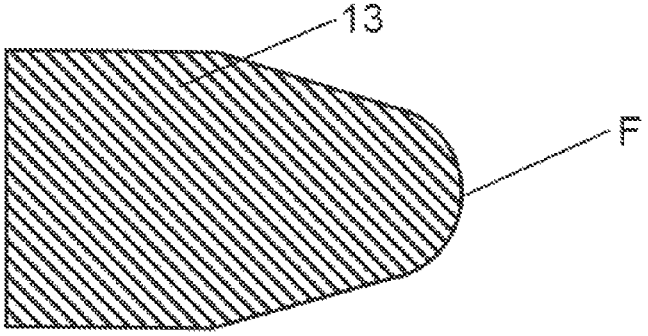
FIG. 8*a* is a schematic sectional representation of an example of a hard core according to the invention.

FIG. 8*a* shows a schematic sectional representation of an example of a hard core 13 according to the invention. The hard core 13 has a rounded front F, and tapers toward the rounded front. The hard core 13 is therefore partially cylindrical in design, wherein a rounded cone adjoins the cylindrical part.

Figure 8B:
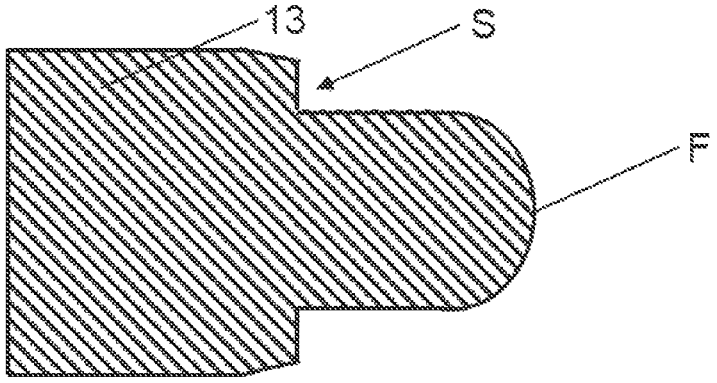
FIG. 8*b* is a schematic sectional representation of another example of a hard core according to the invention.

In accordance with FIG. 8*b*, a schematic sectional representation of another example of a hard core according to the invention is depicted. The front F of the hard core 13 is rounded and the hard core 13 has a step S. The hard core 13 is therefore cylindrical in sections, wherein the front rear, cylindrical part has a chamfer, and the front F of the front, cylindrical part is rounded.

Figure 8C:
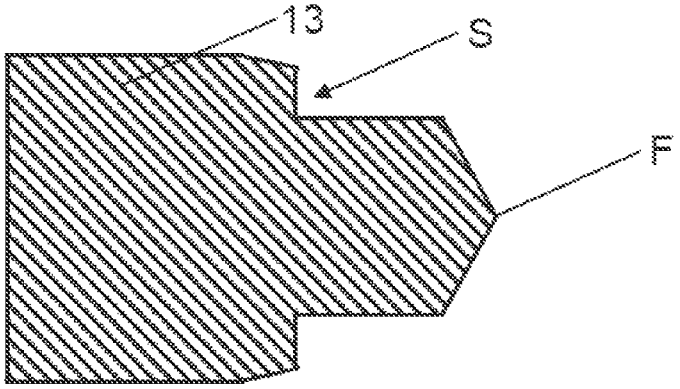
FIG. 8*c* is a schematic sectional representation of another example of a hard core according to the invention.

FIG. 8*c* shows a schematic sectional representation of another example of a hard core 13 according to the invention. The front F of the hard core 13 is pointed. The hard core 13 has a step S. The hard core 13 is therefore cylindrical in sections, wherein the front rear, cylindrical part has a chamfer, and the front F of the front, cylindrical part is pointed.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A projectile comprising:

a sabot;

a tail assembly; and a penetrator, the penetrator comprising:

at least one solid main body that acts in a terminal ballistic manner for attacking an armored target or a tank with reactive armor;

a rear region of the penetrator has, permanently connected to the main body, a hard core that acts in a terminal ballistic manner to increase a penetration effect, wherein the hard core has at least one step.

2. The projectile according to claim 1, wherein the penetrator is an inert penetrator.

3. The projectile according to claim 1, wherein a density of the hard core is greater than a density of the main body.

4. The projectile according to claim 1, wherein the main body comprises a sintered tungsten heavy metal, and the hard core comprises a sintered tungsten heavy metal, wherein the tungsten heavy metal of the hard core is more strongly compacted than the tungsten heavy metal of the main body.

5. The projectile according to claim 1, wherein the hard core tapers toward a front of the penetrator.

6. The projectile according to claim 1, wherein the front of the hard core is pointed or rounded.

7. The projectile according to claim 1, wherein the hard core is arranged within the main body.

8. The projectile according to claim 1, wherein the penetrator is lengthened by the hard core as compared with the length of the main body.

9. The projectile according to claim 1, wherein the rear region tapers towards a rear of the penetrator compared with the main body.

* * * * *